US008979186B2

(12) United States Patent
Walz et al.

(10) Patent No.: US 8,979,186 B2
(45) Date of Patent: Mar. 17, 2015

(54) POWER MECHANISM FOR RECLINERS

(71) Applicant: Ashley Furniture Industries, Inc., Arcadia, WI (US)

(72) Inventors: Lucas R. Walz, Ettrick, WI (US); Peter J. Fynboh, Saint Charles, MN (US); Jeffrey Cooper, Independence, WI (US); Joseph L. Anibas, Alma Center, WI (US); Nicholas J. Robinson, Ettrick, WI (US); Richard E. Gorka, Ettrick, WI (US); John R. Breen, Eleva, WI (US); Timothy A. Brandtner, Ettrick, WI (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 0 days.

(21) Appl. No.: 14/044,573

(22) Filed: Oct. 2, 2013

(65) Prior Publication Data

US 2014/0091606 A1 Apr. 3, 2014

Related U.S. Application Data

(60) Provisional application No. 61/708,989, filed on Oct. 2, 2012, provisional application No. 61/738,737, filed on Dec. 18, 2012, provisional application No. 61/801,967, filed on Mar. 15, 2013.

(51) Int. Cl.

| | |
|---|---|
| ***A47C 1/031*** | (2006.01) |
| ***A47C 1/02*** | (2006.01) |
| ***A47C 1/024*** | (2006.01) |
| ***A47C 1/034*** | (2006.01) |

(52) U.S. Cl.

CPC ..... *A47C 1/02* (2013.01); *A47C 1/0242* (2013.01); *A47C 1/0345* (2013.01)

USPC ..... 297/85 M; 297/68; 297/84

(58) Field of Classification Search

USPC ..... 297/68, 84, 85 L, 85 M, 325, 330, 297/344.14, 344.15, 344.17

See application file for complete search history.

(56) References Cited

U.S. PATENT DOCUMENTS

| | | | | |
|---|---|---|---|---|
| 4,108,491 | A | 8/1978 | Rogers, Jr. | |
| 4,696,512 | A | 9/1987 | Burnett et al. | |
| 4,989,914 | A | 2/1991 | Pine | |
| 5,222,286 | A | 6/1993 | Saul et al. | |
| 5,271,660 | A | 12/1993 | LaPointe et al. | |
| 6,409,262 | B1 | 6/2002 | LaPointe | |
| 6,612,650 | B1 * | 9/2003 | Ambrosio et al. | 297/330 |
| 6,840,575 | B2 | 1/2005 | Hesse | |
| 6,988,769 | B2 | 1/2006 | LaPointe | |
| 7,445,279 | B2 * | 11/2008 | Crum | 297/84 |
| 7,673,933 | B2 | 3/2010 | Lawson | |
| 7,850,232 | B2 | 12/2010 | Casteel | |
| 8,297,693 | B2 | 10/2012 | Hoffman et al. | |
| 8,308,228 | B2 | 11/2012 | Lawson et al. | |
| 2008/0150329 | A1 * | 6/2008 | Lawson | 297/84 |
| 2011/0175404 | A1 | 7/2011 | Lawson | |
| 2011/0193373 | A1 | 8/2011 | Lawson et al. | |
| 2012/0299363 | A1 | 11/2012 | Crum | |

* cited by examiner

*Primary Examiner* — Philip Gabler
(74) *Attorney, Agent, or Firm* — Christensen Fonder P.A.

(57) ABSTRACT

A power mechanism for a recliner having a limiter controlling the relative angle between a transfer linkage and arm affixed to the drive axle as the transfer linkage applies tangential force to the arm to rotate the drive axle. The limiter prevents the relative angle between the transfer linkage from over collapsing to minimize strain on the linkage assembly and the motor driving the rotation of the drive axle.

20 Claims, 21 Drawing Sheets

POWER MECHANISM FOR RECLINERS

PRIORITY CLAIM

This application claims priority to U.S. Provisional Application No. 61/708,989, filed Oct. 2, 2012, U.S. Provisional Application No. 61/738,737, filed Dec. 18, 2012, and U.S. Provisional Application No. 61/801,967, filed Mar. 15, 2013, each of which is hereby fully incorporated herein by reference.

FIELD OF THE INVENTION

The present invention is directed to a power mechanism for driving the movable elements of a recliner. Specifically, the present invention is directed to a power mechanism having a limiter controlling the angular collapse of scissoring transfer linkages in the power mechanism to reduce strain on the linkages and spikes in the applied force from the drive assembly for the power mechanism.

BACKGROUND OF THE INVENTION

A recliner typically comprises a back rest that rotates downward to lower the user's back and head from an upright position to more a reclined position. Similarly, recliners also often comprise a deployable ottoman that extends outwardly to present a leg rest that elevates the user's legs. Certain recliners often also shift the seat box forward to provide room behind the recliner for the lowered back rest. The recliners also often rotate the seat box to elevate the front of the seat box relative to the rear of the seat box to further position the user in a more comfortable reclined position. The back rest, ottoman and seat box of certain recliners are operably linked to a single rotating axle that is rotated by a drive assembly to move the various components such that the moving components can be operated simultaneously.

In operation, the drive axle is rotated in a first direction to lower the leg rest while rotating the leg rest of the ottoman into the reclined position. The drive axle can then be shifted forward to shift the seat box forward and extend the leg rest from the seat box of the recliner. The drive axle can then be shifted backwards and rotated in the opposite direction to return the moving components of the recliner to their original positions.

In certain recliners, the drive axle is rotated by a traveler moved along a horizontal track perpendicular to drive axle by the drive assembly. The traveler is linked to the drive axle by elongated transfer linkages rotatably affixed to the drive axle via a bracket having an arm extending radially outward from the drive axle. As the traveler moves down the horizontal track, the horizontal motion of the traveler is translated into a pushing or pulling force applied tangentially to the drive axle through the arm to rotate the drive axle. As the drive axle is rotated, the angle between the transfer linkage and the arm collapses as the arm of the drive axle rotates until nearly parallel with the horizontal track.

The collapsing angle between the transfer linkage and arm reduces the efficiency of the transfer of force between the traveler and the drive axle, which in turn can place strain on the drive assembly and the linkages. As such there is a need for a means of improving the efficiency of the transfer of force between the traveler and the drive axle.

SUMMARY OF THE INVENTION

A power mechanism, according to an embodiment of the present invention, can comprise a drive axle, a drive assembly, a horizontal track and a traveler. The drive axle further comprises an arm extending radially outward from the drive axle. The traveler further comprises a transfer linkage rotatably affixed to the traveler at one end and rotatably affixed to the arm at the other end. The arm further comprises a limiter engagable to the transfer linkage as the drive axle rotates to control the relative angle of the arm to the transfer linkage. The drive assembly can further comprise a motor and a worm gear positionable within the horizontal track and rotated by the motor to move the traveler along the horizontal track.

As the traveler is moved along the horizontal track by the drive assembly, the transfer linkage translates the horizontal motion of the traveler into a pushing or pulling force tangential to the drive axle applied to the arm to rotate the drive axle a predetermined rotational distance. Rotating the drive axle in a first direction can rotate the leg rest of an ottoman and/or recline a back rest, while rotating the drive axle in the opposite direction can return the ottoman assembly and back rest back to their original positions. Upon fully rotating the drive axle, the arm is positioned generally parallel to the horizontal track such that the pulling or pushing force applied by the transfer linkage is generally transverse to the arm to move the drive axle horizontally in order to shift the seat box forward and extend the leg rest. The angle between the end of the arm and transfer linkage decreases as the drive axle rotates in the first direction until the arm is generally parallel with the horizontal track, which corresponds to the point of least mechanical advantage.

As the drive axle is rotated into the first direction, the decreasing angle between the arm and transfer linkage was found to create a spike in the force that must be applied to the traveler to continue the horizontal motion of the traveler. An even greater spike in the applied force was found as the drive axle was rotated in the opposing second direction increasing the angle between transfer linkage and arm. The limiter prevents the angle between the transfer linkage and the arm from decreasing past a predetermined point. The limited "collapse" angle reduces the spike in applied force by increasing the efficiency of the transfer of force from the traveler to the drive axle through the transfer linkage and arm in either rotational direction. In one aspect, the limiter maintains a greater angle between the transfer linkage and arm during the rotation of the drive axle to increase the efficiency of the power mechanism through the entire rotation of the drive axle. The improve efficiency the overall applied force is minimized reducing the strain placed on the linkages as well as the drive assembly. The reduced strain increases the longevity of the linkages and the motor.

The above summary of the various representative aspects of the invention is not intended to describe each illustrated aspect or every implementation of the invention. Rather, the aspects are chosen and described so that others skilled in the art can appreciate and understand the principles and practices of the invention. The figures in the detailed description that follow more particularly exemplify these aspects.

Still other objects and advantages of the present invention and methods of construction of the same will become readily apparent to those skilled in the art from the following detailed description, wherein only the preferred embodiments are shown and described, simply by way of illustration of the best mode contemplated of carrying out the invention. As will be realized, the invention is capable of other and different embodiments and methods of construction, and its several details are capable of modification in various obvious respects, all without departing from the invention. Accordingly, the drawing and description are to be regarded as illustrative in nature, and not as restrictive.

BRIEF DESCRIPTION OF THE DRAWINGS

The invention can be completely understood in consideration of the following detailed description of various embodiments of the invention in connection with the accompanying drawings, in which.

Figure 1:
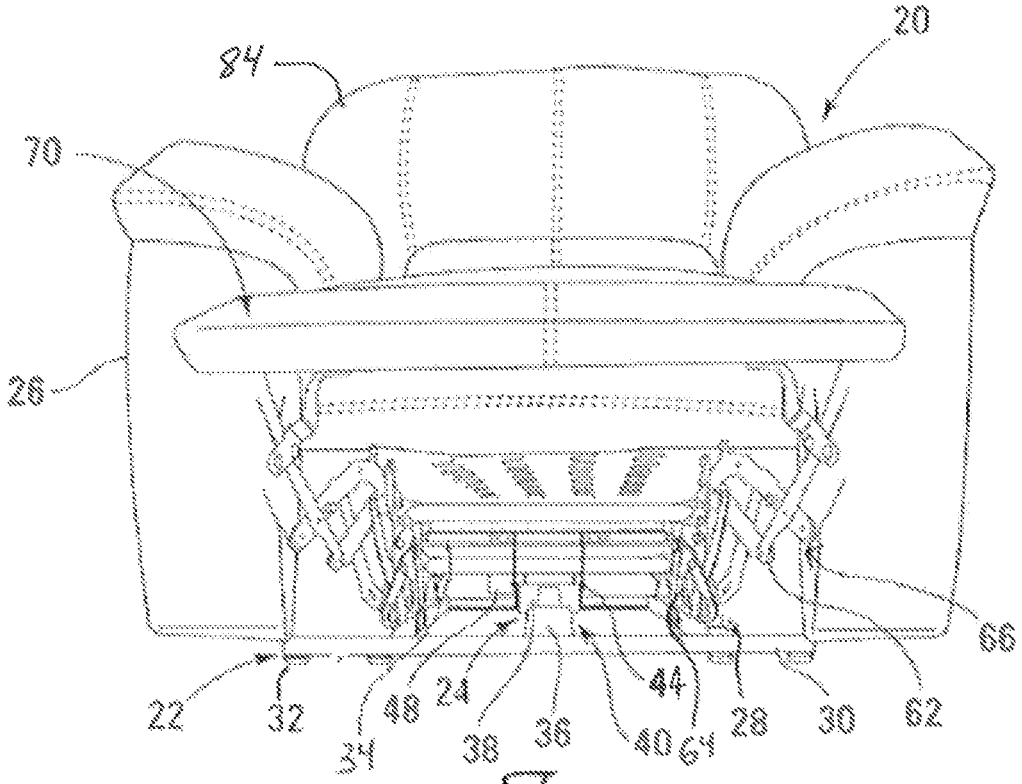
FIG. 1 is a front view of a recliner according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

While this invention may be embodied in many different forms, there are described in detail herein specific embodiments of the invention. This description is an exemplification of the principles of the invention and is not intended to limit the invention to the particular embodiments illustrated.

Figure 2:
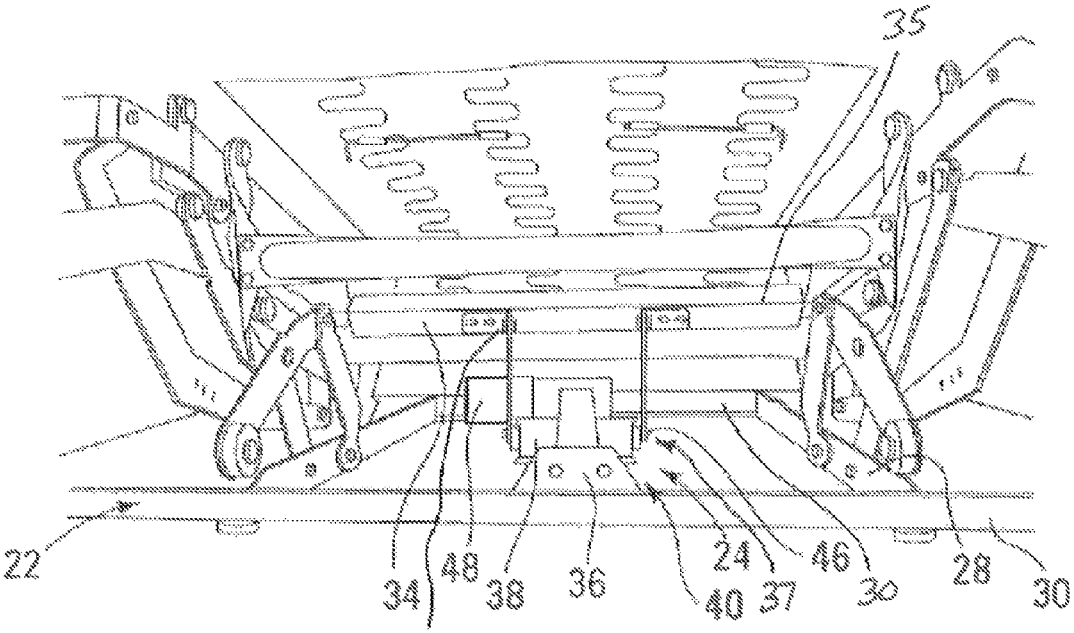
FIG. 2 is a partial front view of the recliner depicted in FIG. 1.
Figure 3:
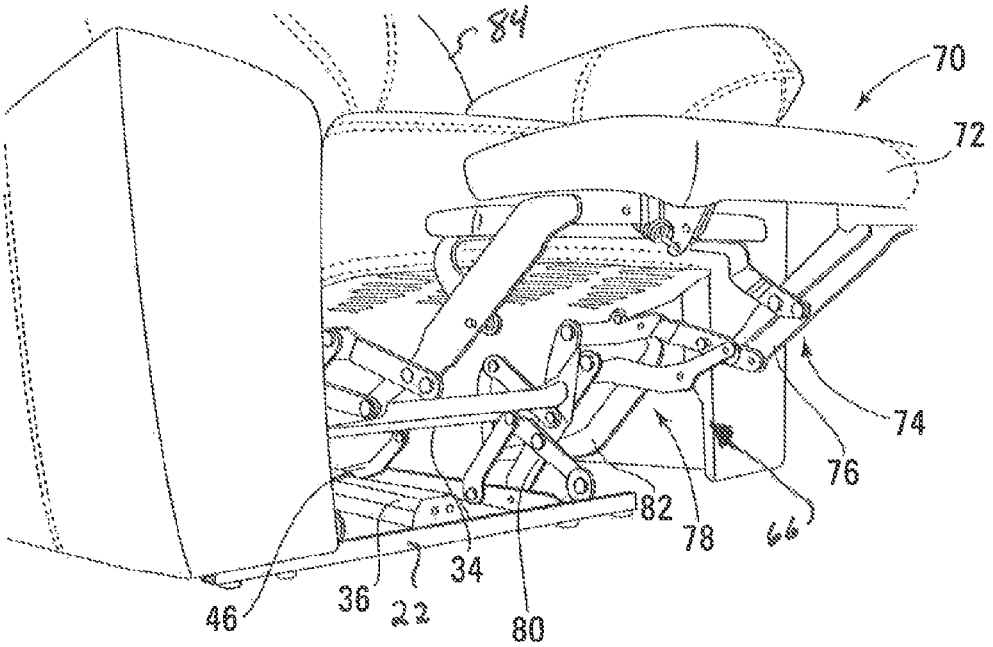
FIG. 3 is a partial perspective view of the recliner depicted in FIG. 1.

As shown in FIGS. 1-3, a recliner 20, according to an embodiment of the present invention, comprises a base 22, a power mechanism 24 and a seat box 26. The base 22 further comprises two longitudinal rails 28 each intersected with two end rails 30 to define a generally rectangular frame for supporting the recliner 20. The base 22 is adapted to be positioned on the ground beneath the recliner 20 and support the recliner 20 during the operation of the recliner 20. In one aspect, the base 22 can further comprise at least one positioning wheel 32, wherein the recliner 20 can be rotated such that the recliner 20 rests on the wheels 32 for repositioning of the recliner 20.

The power mechanism 24 further comprises a drive axle 34, a horizontal track 36, a traveler assembly 37 and a drive assembly 40. The drive axle 34 can further comprise a crossbar 35, which is preferably square in cross-section, and a bracket 41 having an arm 42 secured to the crossbar 35. The arm 42 extends radially outward from the crossbar 35 such that applying a pushing or pulling force to the arm 42 tangentially causes the drive axle 34 to rotate. The traveler assembly 37 comprises a traveler 38 and at least on transfer linkage 44 rotatably affixed to the traveler 38 via a bracket link 39 at one end and rotatably affixed to the arm 42 at point 43 at the opposite end. Each arm 42 can further comprise a limiter 46 positioned at one end of the arm 42 proximate to the transfer linkage 44. The limiter 46 can comprise a nut, a rivet, tab, arm or other protrusion extending from the arm 42 such that the limiter 46 can engage the transfer linkage 44. The drive assembly 40 can further comprise a motor 48 and a worm gear 50 positioned within the horizontal track 36. The horizontal track 36 is mounted to the end rails 30 such that the horizontal track 36 extends between the end rails 30 in parallel to the longitudinal rails 28. In one aspect, the horizontal track 36 can also define a first segment 52 and a second segment 54.

Figure 19:
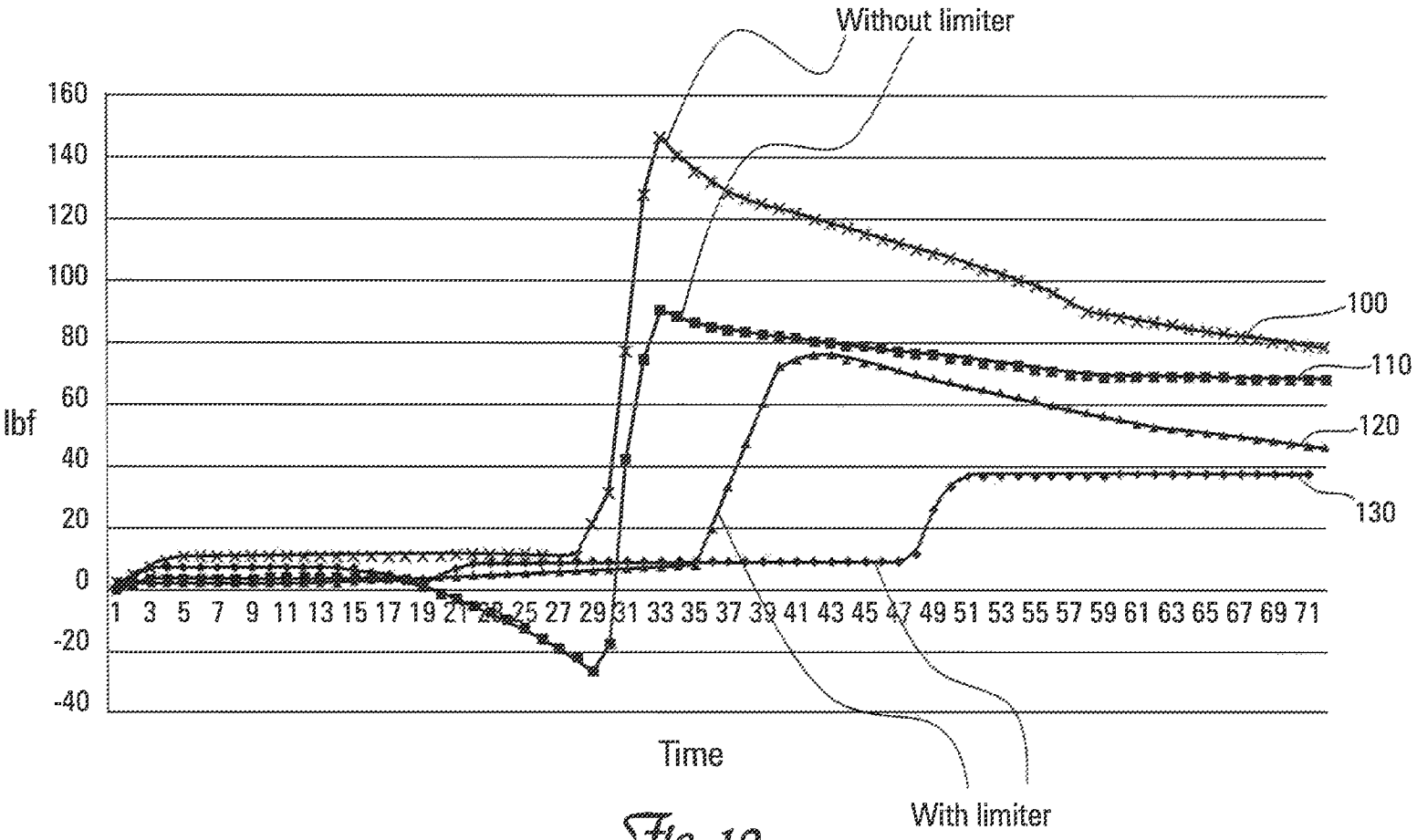
FIG. 19 is a force profile diagram illustrating the force profiles of two linkage assemblies without a limiter according to an embodiment of the present invention and two linkage assemblies with a limiter according to an embodiment of the present invention.

In operation, the traveler 38 is operably engaged to the worm gear 50 such that rotation of the worm gear 50 by the motor 48 in a first direction pushes the traveler 38 down the horizontal track 36 in the first direction, while rotating the worm gear 50 in the opposite second direction pulls the traveler 38 in the opposite direction. Moving the traveler 38 in the first direction through the first segment 52 applies a tangential pushing force to the arm 42 to rotate the drive axle 34 in a first direction until the drive axle 34 has rotated a predetermined rotational distance and the arm 42 is generally parallel to the horizontal track 36. As drive axle 34 is rotated in the first direction, the angle between the arm 42 and the transfer linkage 44 decreases until the limiter 46 engages the transfer linkage 44 to prevent the angle from decreasing below a predetermined angle. In one aspect, the predetermined angle can be at least 60 degrees. In another aspect, the predetermined angle can be at least 150% of the maximum collapsed angle of a transfer linkage 44 without a limiter 46. Similarly, pulling the traveler 38 in the second direction through the first segment 52 applies a tangential pulling force to the arm 42 to rotate the drive axle 34 in an opposite second direction until the drive axle 34 is returned to the original position. As shown in FIG. 19, the greater minimum angle between the arm 42 and the transfer linkage 44 reduces the applied force required to operate the traveler 38 in the reverse direction.

Figure 4:
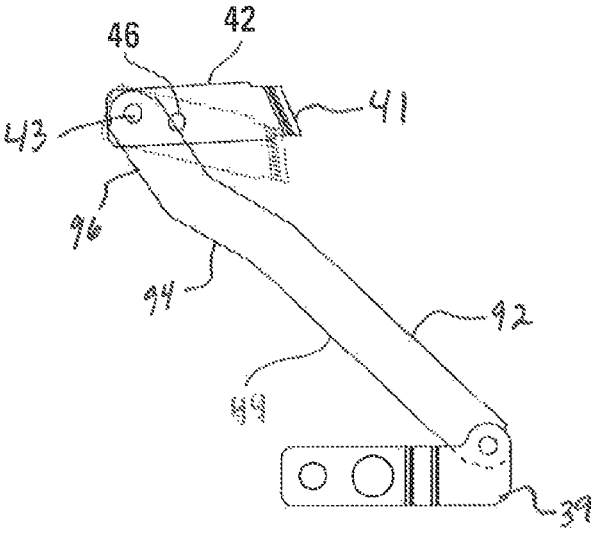
FIG. 4 is a side view of a transfer linkage and arm assembly according to an embodiment of the present invention.
Figure 5B:
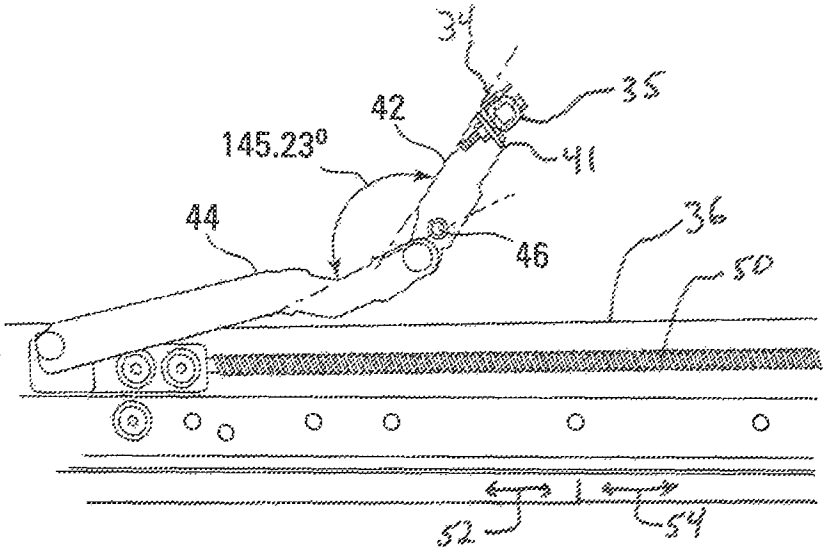
FIG. 5B is a side view of a transfer linkage and arm assembly with a limiter according to an embodiment of the present invention, wherein the traveler is positioned at an initial position.
Figure 5A:
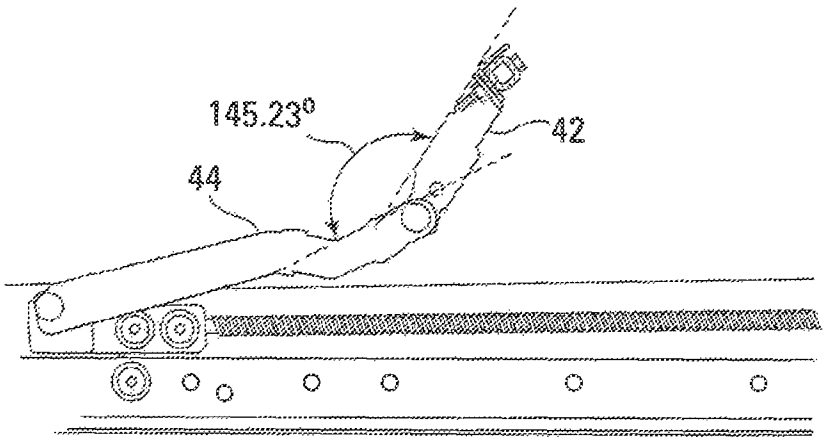
FIG. 5A is a side view of a transfer linkage and arm assembly without a limiter, wherein the traveler is positioned at an initial position.
Figure 6B:
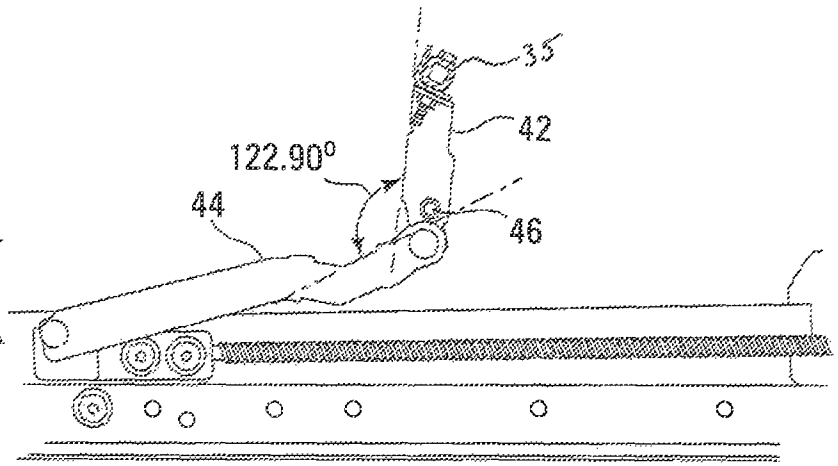
FIG. 6B is a side view of a transfer linkage and arm assembly with a limiter according to an embodiment of the present invention, wherein the traveler has moved one inch from the initial position along the track.
Figure 6A:
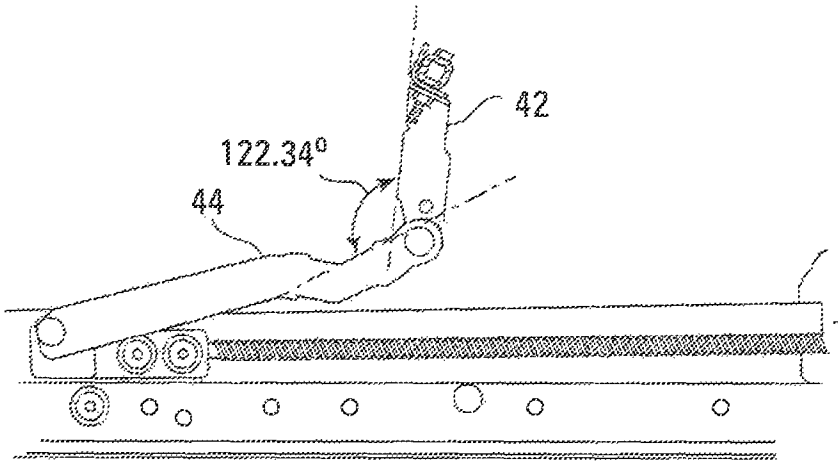
FIG. 6A is a side view of a transfer linkage and arm assembly without a limiter, wherein the traveler has moved one inch from the initial position along the track.
Figure 7B:
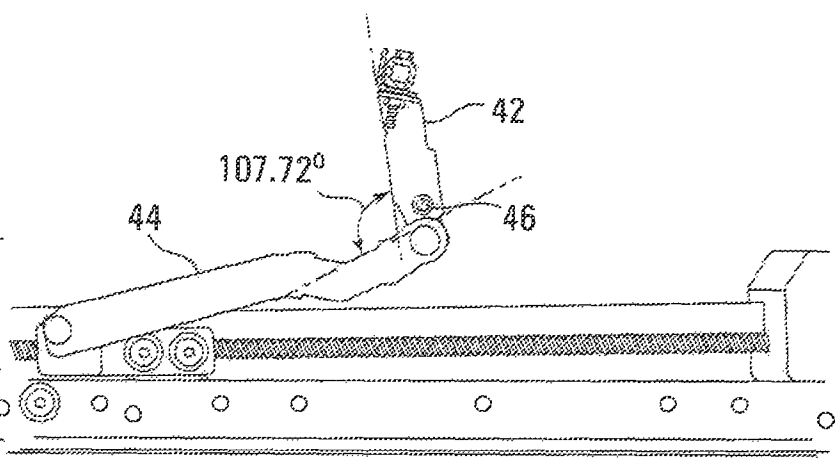
FIG. 7B is a side view of a transfer linkage and arm assembly with a limiter according to an embodiment of the present invention, wherein the traveler has moved two inches from the initial position along the track.
Figure 7A:
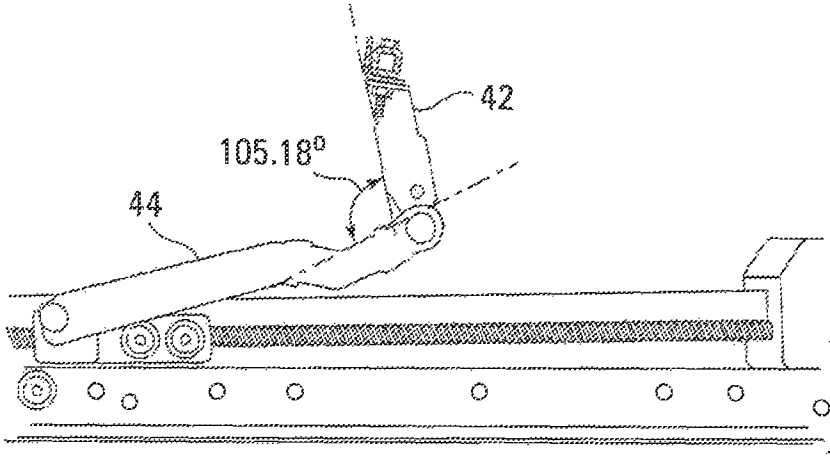
FIG. 7A is a side view of a transfer linkage and arm assembly without a limiter, wherein the traveler has moved two inches from the initial position along the track.
Figure 8B:
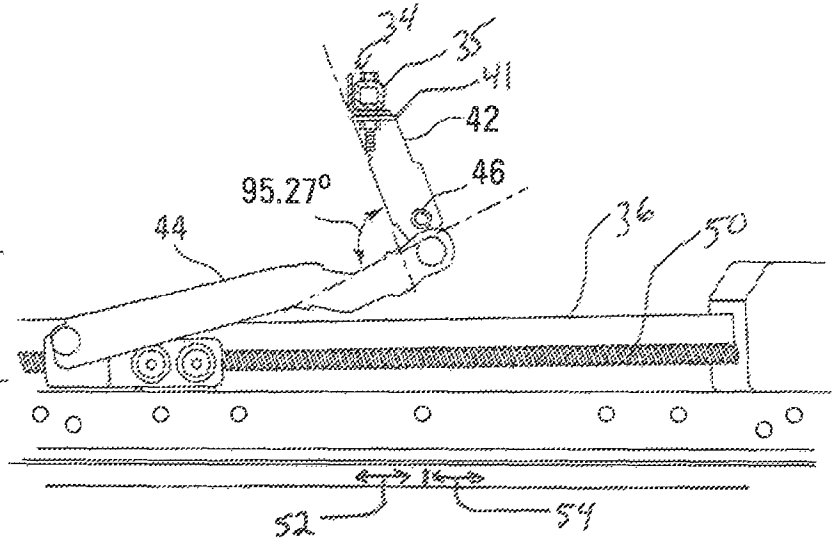
FIG. 8B is a side view of a transfer linkage and arm assembly with a limiter according to an embodiment of the present invention, wherein the traveler has moved three inches from the initial position along the track.
Figure 8A:
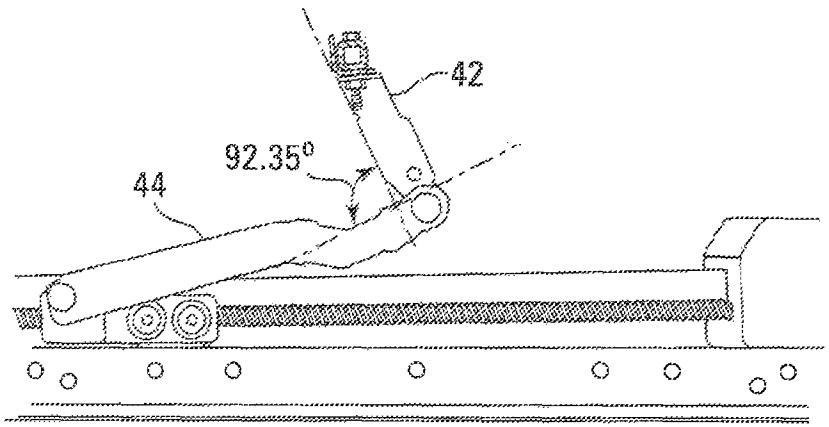
FIG. 8A is a side view of a transfer linkage and arm assembly without a limiter, wherein the traveler has moved three inches from the initial position along the track.
Figure 9B:
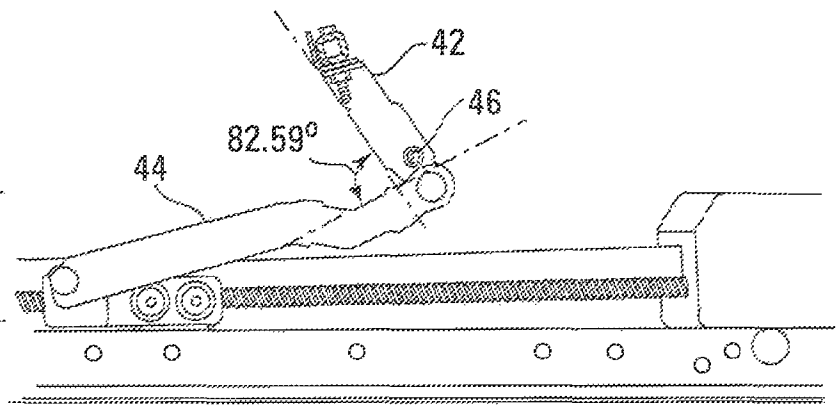
FIG. 9B is a side view of a transfer linkage and arm assembly with a limiter according to an embodiment of the present invention, wherein the traveler has moved four inches from the initial position along the track.
Figure 9A:
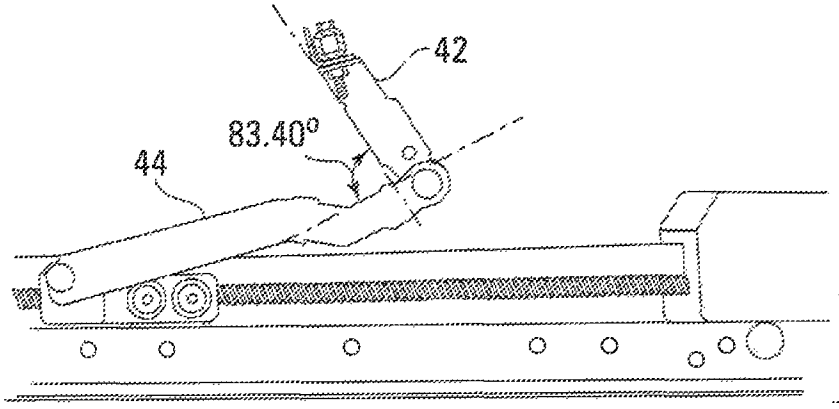
FIG. 9A is a side view of a transfer linkage and arm assembly without a limiter, wherein the traveler has moved four inches from the initial position along the track.
Figure 10B:
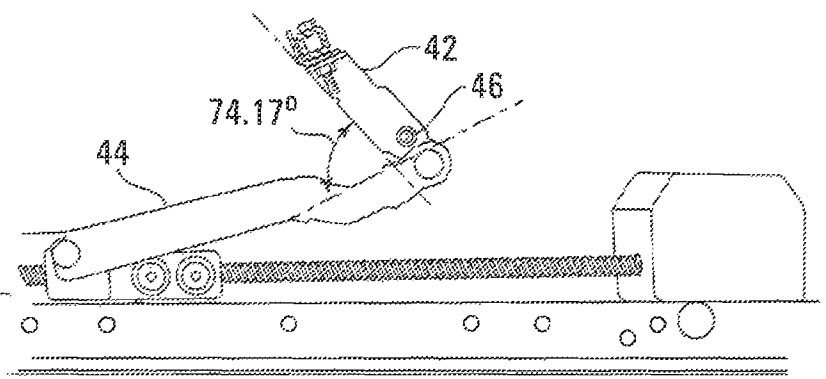
FIG. 10B is a side view of a transfer linkage and arm assembly with a limiter according to an embodiment of the present invention, wherein the traveler has moved five inches from the initial position along the track.
Figure 10A:
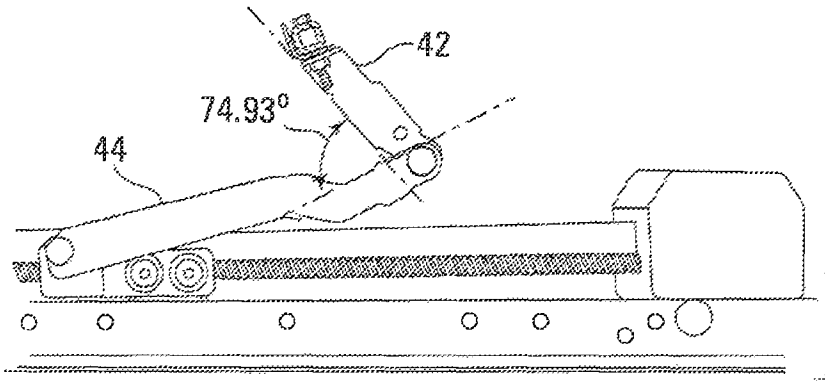
FIG. 10A is a side view of a transfer linkage and arm assembly without a limiter, wherein the traveler has moved five inches from the initial position along the track.

FIG. 4 shows a transfer linkage 44 connected to an arm 42 of a bracket 41. As seen, the arm 42 includes a limiter 46 protruding from the surface of the arm. The limiter can be integral with the arm 42 or be a separate piece protruding from and securing fit in an opening in the arm. As shown, the transfer linkage 44 is rotatably affixed to the bracket link 39 at one end and rotatably affixed to the arm 42 at the other end. The transfer linkage 44 is bent at a predetermined angle. The transfer linkage 44 further comprises a first elongated segment 92, a second segment 94 extending at an angle from the first elongated segment 92 and a third segment 96 extending at an angle from the second segment in a direction opposite of that of the extension of the second segment from the first elongated segment.

Figure 11B:
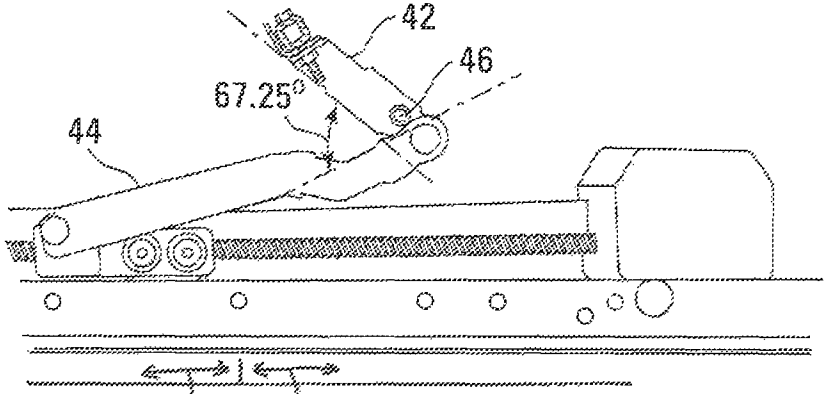
FIG. 11B is a side view of a transfer linkage and arm assembly with a limiter according to an embodiment of the present invention, wherein the traveler has moved six inches from the initial position along the track.
Figure 11A:
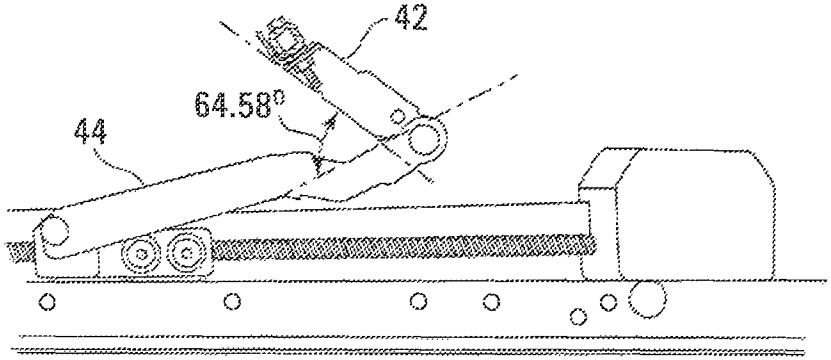
FIG. 11A is a side view of a transfer linkage and arm assembly without a limiter, wherein the traveler has moved six inches from the initial position along the track.
Figure 12B:
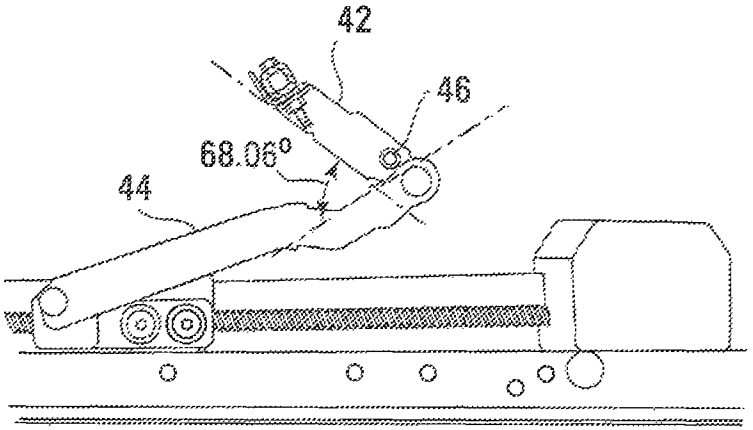
FIG. 12B is a side view of a transfer linkage and arm assembly with a limiter according to an embodiment of the present invention, wherein the traveler has moved seven inches from the initial position along the track.
Figure 12A:
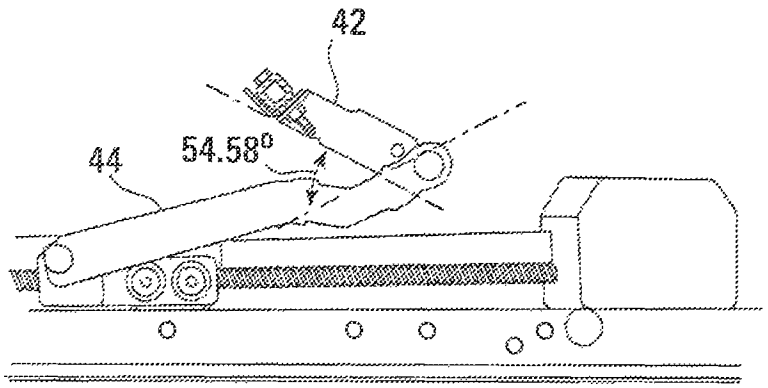
FIG. 12A is a side view of a transfer linkage and arm assembly without a limiter, wherein the traveler has moved seven inches from the initial position along the track.
Figure 13B:
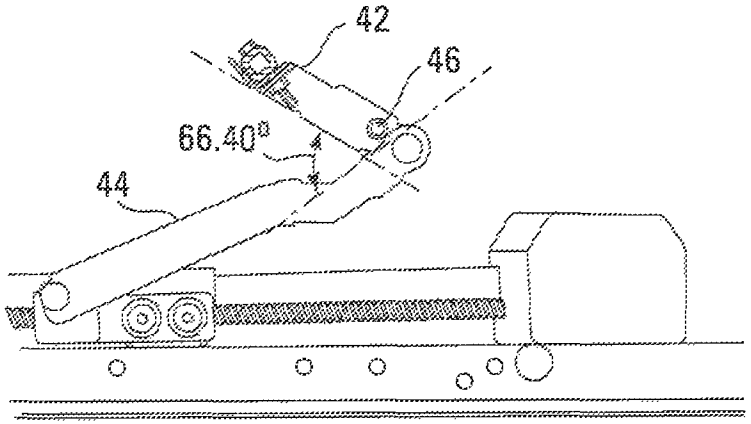
FIG. 13B is a side view of a transfer linkage and arm assembly with a limiter according to an embodiment of the present invention, wherein the traveler has moved eight inches from the initial position along the track.
Figure 13A:
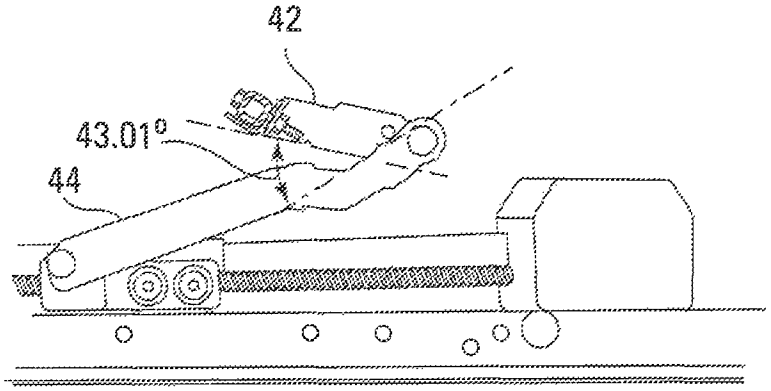
FIG. 13A is a side view of a transfer linkage and arm assembly without a limiter, wherein the traveler has moved eight inches from the initial position along the track.
Figure 14B:
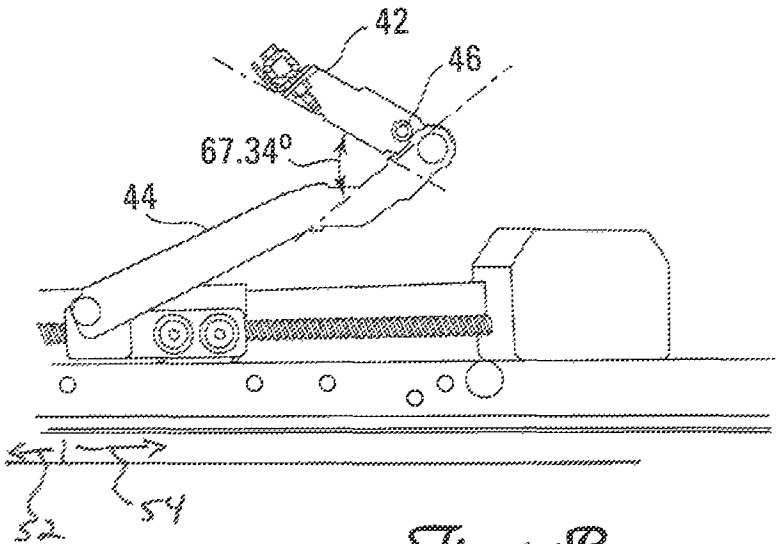
FIG. 14B is a side view of a transfer linkage and arm assembly with a limiter according to an embodiment of the present invention, wherein the traveler has moved nine inches from the initial position along the track.
Figure 14A:
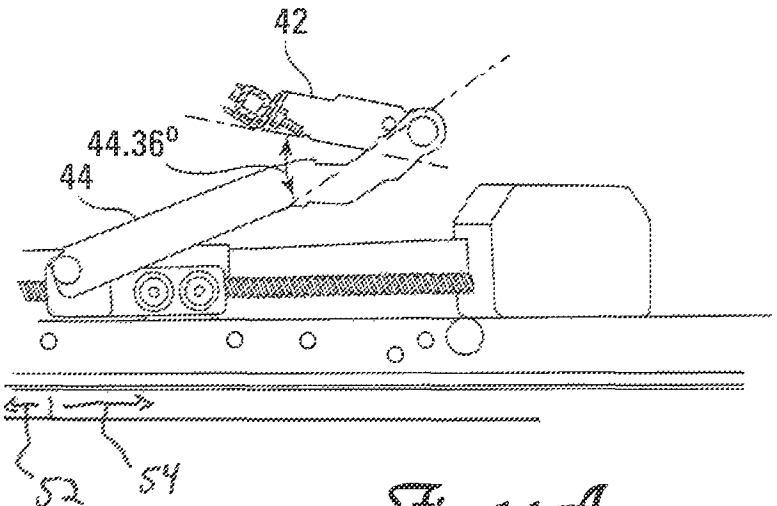
FIG. 14A is a side view of a transfer linkage and arm assembly without a limiter, wherein the traveler has moved nine inches from the initial position along the track.
Figure 15B:
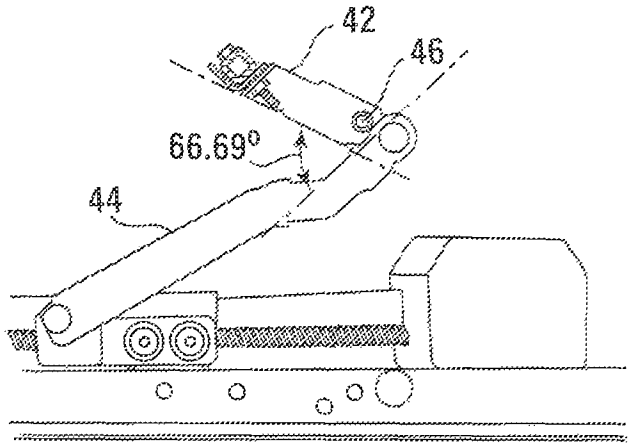
FIG. 15B is a side view of a transfer linkage and arm assembly with a limiter according to an embodiment of the present invention, wherein the traveler has moved ten inches from the initial position along the track.
Figure 15A:
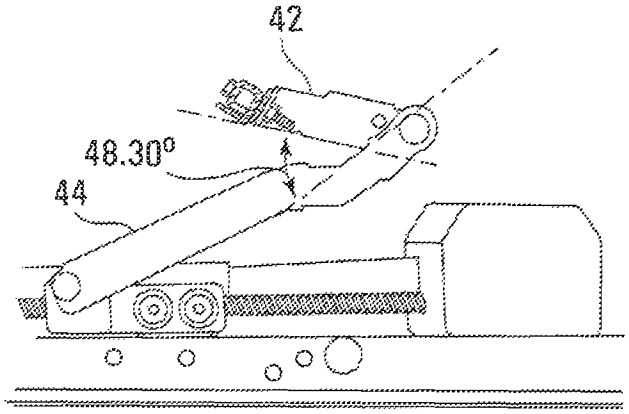
FIG. 15A is a side view of a transfer linkage and arm assembly without a limiter, wherein the traveler has moved ten inches from the initial position along the track.
Figure 16B:
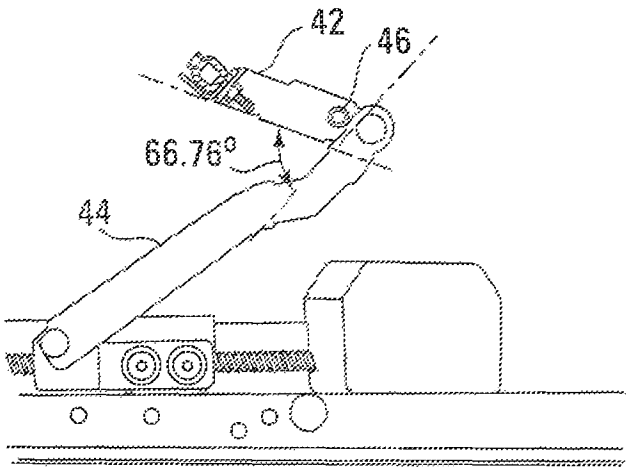
FIG. 16B is a side view of a transfer linkage and arm assembly with a limiter according to an embodiment of the present invention, wherein the traveler has moved eleven inches from the initial position along the track.
Figure 16A:
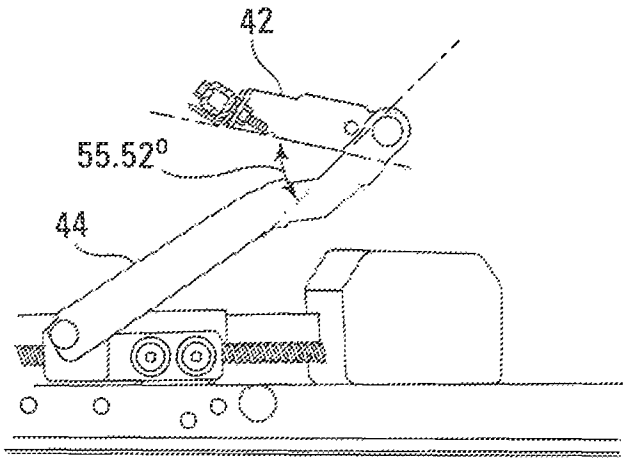
FIG. 16A is a side view of a transfer linkage and arm assembly without a limiter, wherein the traveler has moved eleven inches from the initial position along the track.
Figure 17B:
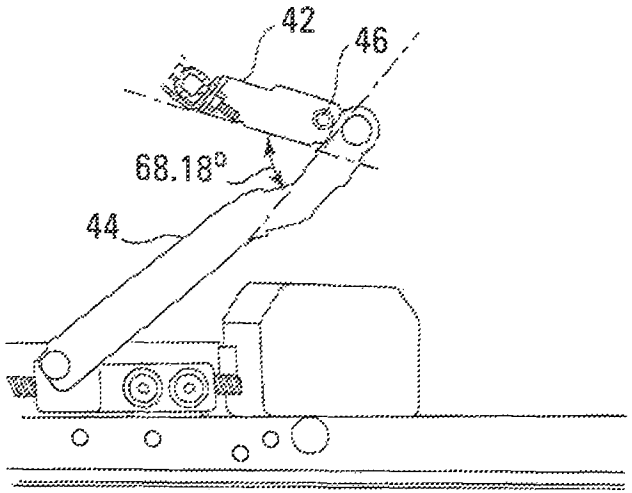
FIG. 17B is a side view of a transfer linkage and arm assembly with a limiter according to an embodiment of the present invention, wherein the traveler has moved twelve inches from the initial position along the track.
Figure 17A:
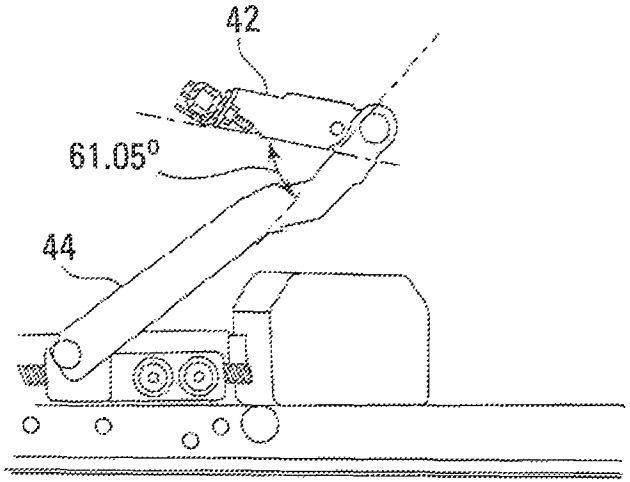
FIG. 17A is a side view of a transfer linkage and arm assembly without a limiter, wherein the traveler has moved twelve inches from the initial position along the track.

As shown in FIGS. 5A-17B, in one embodiment, the limiter 46 can engage the transfer linkage 44 through a portion of the rotation of the drive axle 34 (starting in the figures in about FIG. 11B) to maintain the angle between the transfer linkage 44 and the arm 42 at a greater relative angle to improve the efficiency of force transfer from the traveler 38 to the drive axle 34 throughout the rotation of the drive axle 34. As shown in the figures, the angle is maintained in the range of about 66 to about 68 degrees. The limiter 46 maintains a greater relative angle through the rotation of the drive axle 34 than the relative angle of a transfer linkage 44 without a limiter 46. As shown in FIG. 19, in this configuration, the increased force transfer efficiency through the rotation of the drive axle 34 dampens the spike in applied force applied by the traveler 38.

FIGS. 5A-17B show a traveler assembly 37 driving an arm 42 secured to a crossbar 35 along a horizontal track 36 via worm gear 50 and a motor 48. Each figure shows an inch in longitudinal movement. The embodiment shown shows the motor 48 on the right during the traveler's 38 movement along the first segment 52 and the second segment 54. In a further embodiment, the motor 48 would be on the left side of the traveler 38. As can be seen in FIGS. 5B-17B, the drive axle 34 substantially stops its rotation in the second segment 54, during the pulling of the drive axle 34 by the traveler 38. It can also be seen how the transfer linkage 44 and arm 42 rises up with the drive axle 34 while the seat box 26 rises during its forward movement.

Figure 18:
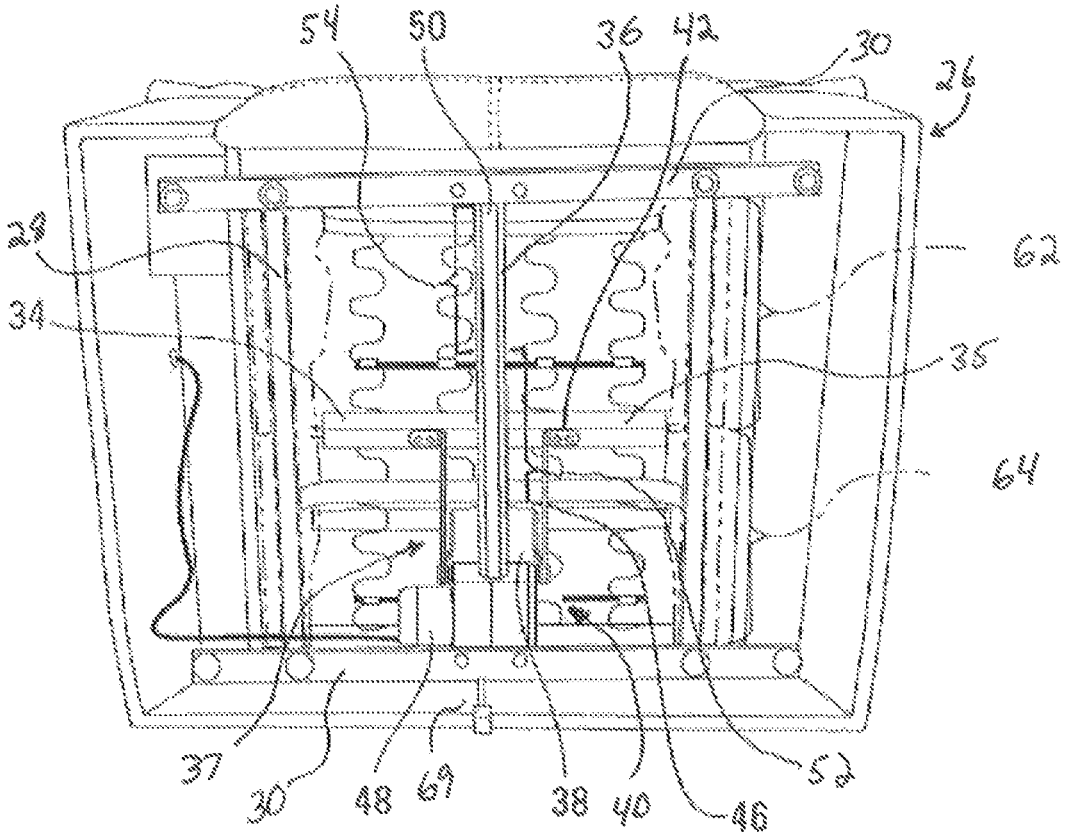
FIG. 18 is a bottom view of the recliner depicted in FIG. 1.

As shown in FIG. 18, the length of the first segment 52 corresponds to the necessary horizontal travel distance of the traveler 38 to rotate the drive axle 34 the necessary rotational distance. Continuing the movement of the traveler 38 into the second segment 54 maintains the rotation of the drive axle 34 while applying an axial pull force to the arm 42 to move the drive axle 34 horizontally with the traveler 38. Similarly, moving the traveler 38 in the second direction through the second segment 54 moves the drive axle 34 horizontally in the opposite direction until the traveler 38 reaches the first segment 52.

The seat box 26 further comprises a box frame 60, at least two forward swing linkage assemblies 62 and at least two rear swing linkages 64. Each forward swing linkage assembly 62 comprises scissoring linkages 66 movable between a generally bent orientation and a generally elongated orientation. The seat box 26 also further comprises at least one drive axle bracket 68 for rotatably receiving the drive axle 34. In the embodiment shown, the drive axle bracket further serves as a seat mounting plate. As shown in FIG. 3, the two forward swing linkage assemblies 62 are each rotatably affixed at one end to the box frame 60 proximate to the front of the seat box 26 and rotatable affixed to the corresponding longitudinal rail 28 at the opposite end proximate to the front of the base 22. Similarly, the two rear swing linkages 64 are rotatable affixed at one end to the box frame 60 proximate to the rear of the seat box 26 and rotatable affixed to the corresponding longitudinal rail 28 at the opposite end proximate to the rear of the base 22.

In operation, moving the traveler 38 in the first direction through the second segment 54 moves the seat box 26 forward relative to the base 22. As shown in FIG. 1-3, moving the seat box 26 forward relative to the base 22 extends the scissoring linkages 66 of the forward swing assemblies 62 to elevate front of the seat box 26 as the seat box 26 moves forward. Similarly, moving the traveler 38 in the second direction through the second segment 54 moves the seat box 26 backwards relative to the base 22 and folds the scissoring linkages 66 to return the seat box 26 to the original orientation. In one aspect, the seat box 26 can further define a notch or opening 69 in the rear of the seat box 26 such that the edge of the seat box 26 does not engage the motor 48 as the seat box 26 is moved forward with the lowered rear end.

FIG. 19 is a force profile diagram illustrating the force profiles of two linkage assemblies without a limiter 100, 110, according to an embodiment of the present invention and two linkage assemblies with a limiter 112, 114, according to an embodiment of the present invention. As shown, the greater minimum angle between the arm 42 and the transfer linkage 44 reduces the applied force required to operate the traveler 38 in the reverse direction. The increased force transfer efficiency through the rotation of the drive axle 34 dampens the spike in applied force applied by the traveler 38.

As shown in FIGS. 1-3, the recliner 20 further comprises an ottoman assembly 70 integrated into the seat box 26. The ottoman assembly 70 comprises a leg rest 72, an extension assembly 74 having a plurality of scissoring linkages 76, and a lever assembly 78. The scissoring linkages 76 of the extension assembly 74 are adapted to rotate the leg rest 72 such that the leg rest 72 is generally parallel to the top of the seat box 26. The lever assembly 78 further comprises a transfer linkage 80 and a lever linkage 82. The lever linkage 82 is operably engaged to drive axle 34 such that rotating the drive axle 34 rotates the lever linkage 82. The transfer linkage 80 is operably engaged to the lever linkage 82 and extends between the lever linkage 82 and the leg rest 72 to transfer the rotation of the drive axle 34 to a corresponding movement in the leg rest 72 via the extension assembly 74. In one aspect, the leg rest 72 defines the front the seat box 26.

In operation, moving the traveler 38 through the first segment 52 in the first direction rotates the drive axle 34 in the first direction applying a pushing force on the leg rest 72 through the lever assembly 78 to extend the extension assembly 74 and position the leg rest 72 in an orientation generally parallel to the top of the seat box 26. Similarly, moving the traveler 38 in the second direction through the first segment 52 rotates the drive axle 34 in the second direction applying a pulling force on the leg rest 72 through the lever assembly 78 to retract the extension assembly 74 to return the leg rest 72 to the original position. In one aspect, the ottoman assembly 74 can be mounted to the seat box 26 on a floating assembly such that the horizontal movement of the drive axle 34 extends the leg rest 72 out from the seat box 26.

Figure 20:
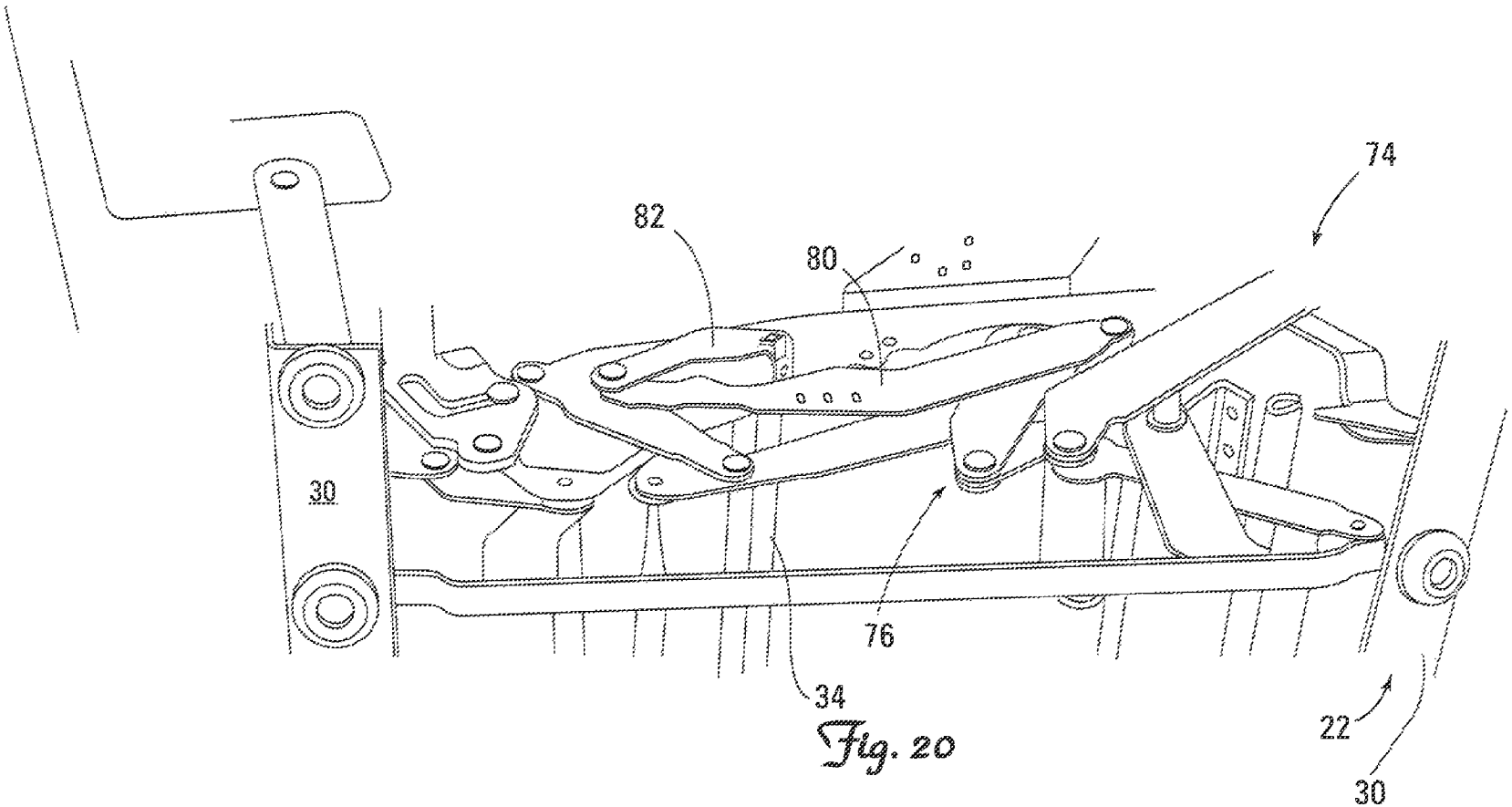
FIG. 20 is a partial side perspective view of the swing linkages of the recliner when the ottoman assembly is in its closed position.
Figure 21:
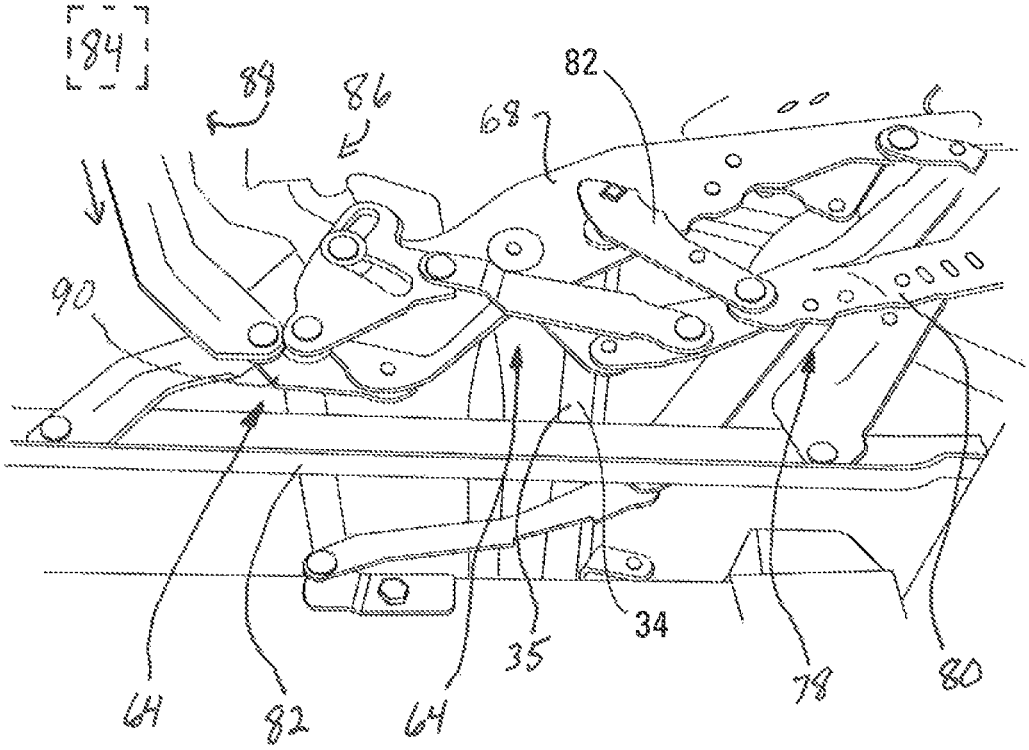
FIG. 21 is a partial side perspective view of the swing linkages of the recliner when the ottoman assembly is in its extended position.
Figure 22:
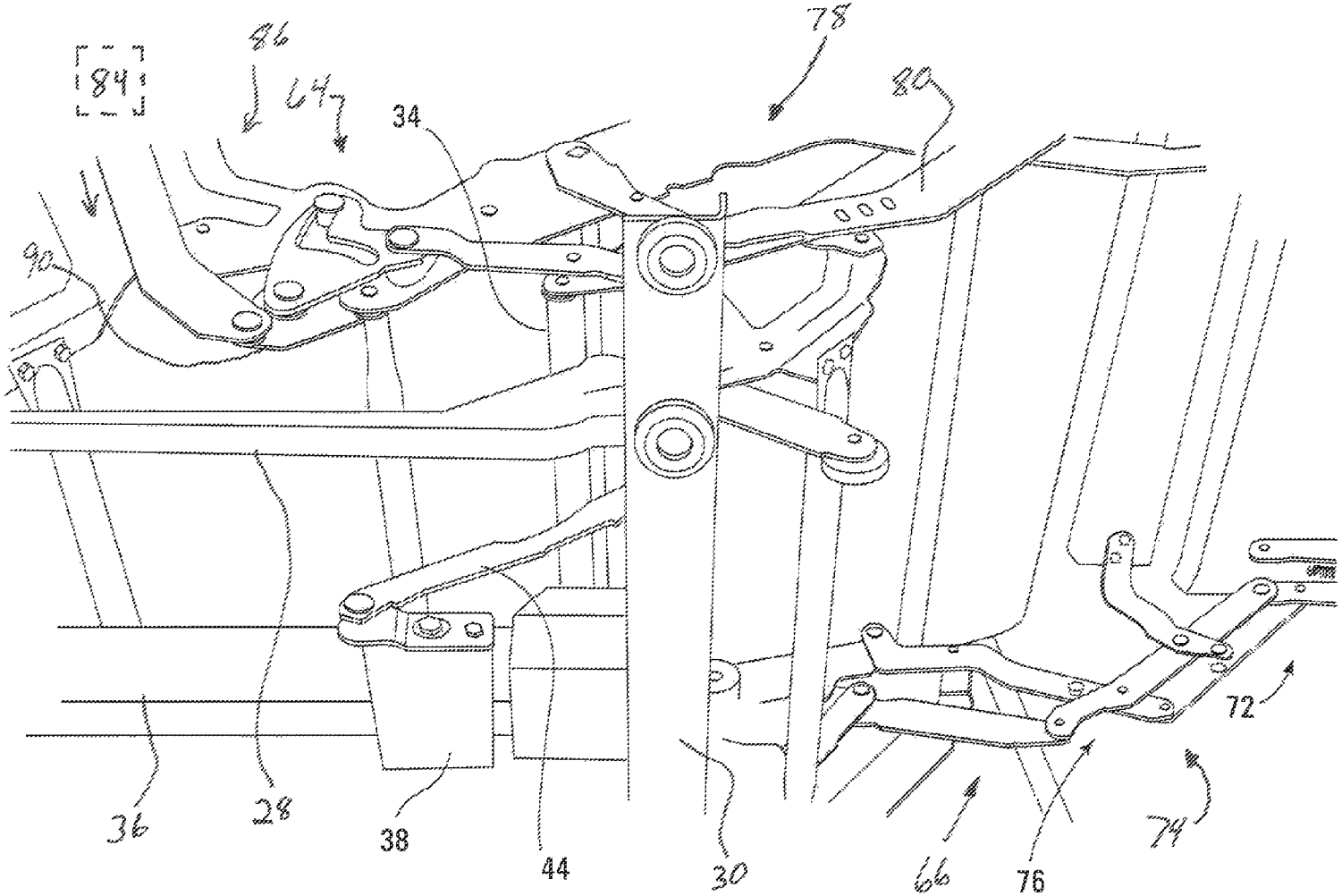
FIG. 22 is a partial side perspective view of the swing linkages of the recliner when the ottoman assembly is in its extended position and the seat back is reclined.

FIGS. 20-22 are partial side perspective views of the swing linkages of the recliner when the ottoman assembly is in its closed position, extended position and extended position with the seat back is reclined, respectively. From the closed position to the extended position, the traveler assembly moves through the first segment of the track. As the traveler assembly goes through the second segment, the seat back is reclined.

The recliner 20 further comprises a back rest 84 integrated into the seat box 26. The back rest 84 further comprises a hinge assembly 86 having at least one hinge 88 rotatably engaging the back rest 84 to the seat box 26. The hinge assembly 86 further comprises at least one positioning lever linkage 90 operably linking the back rest 84 to the drive axle 34. In operation, rotating the drive axle 34 in the first direction is translated through the lever linkage 90 into a pushing force that reclines the back rest 84 backwards. Similarly, rotating the drive axle 34 in the second direction is translated through the lever linkage 90 into a pulling force that pulls the back rest 84 back to the original seating position.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

| REFERENCES | | |
|---|---|---|
| U.S. Pat. No. 7,850,232 | U.S. Pat. No. 7,673,933 | US Pub 20110193373 |
| US Pub 20120299363 | U.S. Pat. No. 8,308,228 | U.S. Pat. No. 8,297,693 |
| U.S. Pat. No. 6,988,769 | U.S. Pat. No. 6,840,575 | U.S. Pat. No. 6,409,262 |
| U.S. Pat. No. 5,222,286 | | |

The above references in all sections of this application are herein incorporated by references in their entirety for all purposes. For purposes of interpreting the claims for the present invention, it is expressly intended that the provisions of Section 112, sixth paragraph of 35 U.S.C. are not to be invoked unless the specific terms "means for" or "step for" are recited in a claim.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A recliner, comprising a seat box having a front and a back;

a base defining a frame positioned under the seat box, the frame having a front portion and a back portion;

a drive axle, the drive axle comprising a crossbar; and an arm extending radially outward from the crossbar and comprising a limiter, the limiter extending radially from a side of the arm; and a power mechanism for powering a change in orientation of the recliner, wherein the power mechanism comprises a track having an axis, a first end and a second end, wherein the axis of the track runs from the front portion to the back portion of the frame and the first end is fixed to the back portion and the second end is fixed to the front portion; and a traveler assembly being movable along the track, the traveler assembly comprising a traveler and a transfer linkage rotatably affixed to the traveler at one end and rotatably affixed to arm at the other end, wherein moving the traveler assembly in a first direction along the track applies a force to the arm to rotate the drive axle in a first direction until the drive axle has rotated a predetermined rotational distance, and wherein, as the drive axle is rotated in the first direction, an angle between the arm and the transfer linkage decreases until the limiter engages the transfer linkage and prevents the angle from decreasing below a predetermined angle.

2. The recliner of claim 1, wherein the arm is fixedly secured to an elongated surface of the crossbar and the arm extends radially outward from the crossbar at an angle relative to the elongated surface.

3. The recliner of claim 1, wherein the predetermined angle is at least 60 degrees.

4. The recliner of claim 1, wherein the predetermined angle is at least 150% of the maximum collapsed angle of a transfer linkage and arm without a limiter.

5. The recliner of claim 1, wherein the limiter comprises a nut, a rivet, a tab, a pin or a raised portion on the arm.

6. The recliner of claim 1, wherein the traveler assembly comprises two transfer linkages rotatably affixed to the traveler and rotatably affixed to the drive axle.

7. The recliner of claim 1, wherein the transfer linkage is bent at a predetermined angle, the transfer linkage having a first elongated segment, a second segment extending at an angle from the first elongated segment and a third segment extending at an angle from the second segment in a direction opposite of that of the extension of the second segment from the first elongated segment.

8. The recliner of claim 1, the power mechanism further comprising a drive assembly, the drive assembly comprising a motor, wherein the motor drives the traveler assembly to effectuate the change in orientation of the recliner.

9. The recliner of claim 8, wherein the motor is positioned adjacent to the back portion, such that the traveler is positioned between the motor and the front portion, relative to the axis of the track.

10. The recliner of claim 8, wherein the drive assembly further comprises a worm gear positioned within the track, wherein the worm gear moves the traveler.

11. The recliner of claim 8, wherein, in operation, the traveler is operably engaged to a worm gear, such that rotation of the worm gear by the motor in a first direction pushes the traveler down the track in a first direction, while rotating the worm gear in the opposite second direction pulls the traveler in the opposite direction, wherein moving the traveler in the first direction through the a first segment applies a tangential pushing force to the arm portion to rotate the drive axle in a first direction until the drive axle has rotated a predetermined rotational distance, the length of the first segment corresponding to the necessary travel distance of the traveler to rotate the drive axle the necessary rotational distance, continuing the movement of the traveler into a second segment maintains the rotation of the drive axle while applying an axial pull force to the arm portion to move the drive axle horizontally with the traveler, similarly, moving the traveler in the second direction through the second segment moves the drive axle horizontally in the opposite direction until the traveler reaches the first segment, wherein pulling the traveler in the second direction through the first segment applies a tangential pulling force to the arm portion to rotate the drive axle in an opposite second direction until the drive axle is returned to the original position.

12. The recliner of claim 8, wherein as the traveler is moved along the track by the drive assembly, the transfer linkage translates horizontal motion of the traveler into a pushing or pulling force tangential to the drive axle applied to the arm to rotate the drive axle a predetermined rotational distance, and the transfer linkage translates horizontal motion of the traveler into a pushing or pulling force wherein, rotating the drive axle in a first direction rotates a leg rest of an ottoman and longitudinally moving the drive axle in a first direction reclines a back rest, while rotating the drive axle in the opposite direction can return the ottoman assembly and longitudinally moving the drive axle in the opposite direction can return the back rest back to its original position.

13. The recliner of claim 1, the drive axle being oriented substantially perpendicular with the track axis, wherein movement of the traveler along a portion of the track applies a force on the drive axle effectuating a rotation of the drive axle, which in turn effectuates a change in orientation of the recliner, and wherein further movement of the traveler along a further portion of the track in the same direction applies a force on the drive axle effectuating a longitudinal movement of the drive axle, which in turn effectuates a further change in orientation of the recliner.

14. The recliner of claim 13, the power mechanism further comprising a drive assembly, the drive assembly comprising a motor, wherein the motor drives the traveler assembly to effectuate the change in orientation of the recliner, wherein the track defines a first segment and a second segment, in effectuating the change in orientation of the recliner, the traveler moves along the track from a position adjacent to the motor, through the first segment and then the second segment to the front portion, wherein, when the traveler moves in the first segment, the traveler assembly rotates the drive axle and the crossbar remains substantially longitudinally fixed relatively fixed relative to the traveler, and, when the traveler moves in the second segment, the crossbar moves longitudinally in with the traveler.

15. The recliner of claim 14, the movement of the traveler assembly in the first segment effectuates the extension of a leg rest and the movement of the traveler assembly in the second segment effectuation the reclining of a back rest.

16. The recliner of claim 1, the base defining a generally rectangular frame and comprising at least two longitudinal rails running parallel with the track and a front rail and a back rail, each intersecting with the two longitudinal rails, wherein the first end of the track is secured to the back rail and the second end is secured to the front rail.

17. The recliner of claim 16, wherein the seat box further comprises a box frame, at least two forward swing linkage assemblies and at least two rear swing linkages, each forward swing linkage assembly comprising scissoring linkages movable between a generally bent orientation and a generally elongated orientation, the recliner further comprising an ottoman assembly integrated into the seat box, wherein the ottoman assembly comprises a leg rest, an extension assembly having a plurality of scissoring linkages, and a lever assembly, the traveler assembly actuating the ottoman assembly upon movement along the track.

18. The recliner of claim 1, wherein, as the drive axle is rotated into the first direction and the angle between the arm and transfer linkage decreases, the limiter reduces the force that must be applied to the traveler to continue the horizontal motion of the traveler and prevents the angle between the transfer linkage and the arm from decreasing past a predetermined point, creating a limited "collapse" angle so as to reduce a spike in applied force by increasing the efficiency of the transfer of force from the traveler to the drive axle through the transfer linkage and arm in either rotational direction, as compared to a recliner without a limiter.

19. A power mechanism for a recliner comprising a motor and a limiter controlling the angular relationship between a transfer linkage and an arm of a drive axle, wherein, during actuation of the recliner, as the transfer linkage applies tangential force to the arm to rotate a drive axle, the limiter prevents a relative angle between the transfer linkage and the arm from over collapsing, such that the relative angle between the transfer linkage and the arm through a rotation of the drive axle is maintained at an angle which is greater than the relative angle of an atm without a limiter.

20. A power mechanism for a recliner comprising a motor and a limiter controlling the angular relationship between a transfer linkage and an arm of a drive axle, wherein, during actuation of the recliner, as the transfer linkage applies tangential force to the arm to rotate a drive axle, the limiter prevents a relative angle between the transfer linkage and the arm from over collapsing and effectuates an increased force transfer efficiency through the rotation of the drive axle dampening the spike in applied force applied by a traveler as compared to using an arm without a limiter.

* * * * *

UNITED STATES PATENT AND TRADEMARK OFFICE

CERTIFICATE OF CORRECTION

PATENT NO. : 8,979,186 B2
APPLICATION NO. : 14/044573
DATED : March 17, 2015
INVENTOR(S) : Lucas R. Walz et al.

It is certified that error appears in the above-identified patent and that said Letters Patent is hereby corrected as shown below:

Claims

Column 10, Line 3, claim 11, delete “the a first” and insert --a first--

Column 10, Line 21, claim 12, delete “wherein as” and insert --where, as--

Column 12, Line 10, claim 19, delete “atm” and insert --arm--

Signed and Sealed this
Nineteenth Day of January, 2016

Michelle K. Lee

Michelle K. Lee
*Director of the United States Patent and Trademark Office*